United States Patent [19]

Sayles

[11] 4,034,675

[45] July 12, 1977

[54] CATALYSTS - CONTAINING ABLATIVE RESONANCE SUPPRESSORS

[75] Inventor: David C. Sayles, Huntsville, Ala.

[73] Assignee: The United States of America as represented by the Secretary of the Army, Washington, D.C.

[21] Appl. No.: 72,558

[22] Filed: Aug. 20, 1970

[51] Int. Cl.[2] ..... F42B 1/00

[52] U.S. Cl. ..... 102/102; 149/108.8

[58] Field of Search ..... 149/109, 108.8; 102/102

[56] References Cited

U.S. PATENT DOCUMENTS

| | | | |
|---|---|---|---|
| 3,109,374 | 11/1963 | Rumbel et al. | 102/102 |
| 3,128,706 | 4/1964 | Rumbel | 102/102 X |
| 3,140,663 | 7/1964 | Rumbel et al. | 102/102 |
| 3,310,946 | 3/1967 | Dobbins | 149/109 X |
| 3,447,981 | 6/1969 | Sayles | 149/109 X |

*Primary Examiner*—Stephen J. Lechert, Jr.
*Attorney, Agent, or Firm*—Nathan Edelberg; Robert P. Gibson; Jack W. Voigt

[57] ABSTRACT

Burning rate promoter (e.g. n-butylferrocene, n-hexylcarborane) is incorporated into resonance rods that are used to eliminate combustion instability of solid propellant. As the solid propellant burning progresses the resonance rods undergo ablation, and as ablation takes place, subsurface quantities of the burning rate promoter are exposed and continuously released into the combustion zone to catalyze the combustion process. This invention also employs porous resonance rods which contain the burning rate promoter and a selected material for suppressing combustion instability as infiltrants.

9 Claims, No Drawings

CATALYSTS - CONTAINING ABLATIVE RESONANCE SUPPRESSORS

DEDICATORY CLAUSE

The invention described herein may be manufactured, used, and licensed by or for the Government for governmental purposes without the payment to me of any royalties thereon.

BACKGROUND OF THE INVENTION

Various methods have been employed to obtain high burning rate propellants. One method of obtaining very high burning rates from propellants has been through the use of aluminum staples. The use of staple, however, complicates the processing of the propellant because special casting techinques are necessary to avoid orientation of the fibers along flow lines. The more recent use of liquid burning rate catalysts (particularly of the organoiron or carborane types) has resulted in problems associated with the use of such catalysts, such as, their relatively high volatility, their high freezing points, and their tendencies to migrate within the propellant and into the liner and insulation of the rocket motor. In order to overcome these migratory tendencies, it has been necessary to incorporate high percentages of burning rate promoter into the insulation to produce a near-equilibrium situation insofar as catalyst migration is concerned, thus further complicating the manufacture of these types of solid rocket motors.

Well known in the solid propellant rocket motor art is the manufacture of resonance rods and their use in solid propellant rocket motor to eliminate combustion instability. Such resonance rods are usually fabricated from asbestos-reinforced phenolic resin. The function of resonance rods is the suppression of combustion instability.

Advantageous would be resonance rods which serve a dual purpose.

Therefore, an object of this invention is to provide resonance rod which serve a dual purpose (e.g., suppression of combustion instability and catalyzing the burning of the solid propellant).

Another object of this invention is to provide resonance rods of the ablative type formulation which contain a burning rate promoter as part of the formulation.

Still another object of this invention is to provide porous resonance rods infiltrated with additives which suppress combustion instabilities and which serve to promote burning rate of propellants.

SUMMARY OF THE INVENTION

Resonance rods containing phenol-formaldehyde resin (40–60) percent by weight, a filler selected from carbon black and asbestos (25–55) percent be weight, and a burning rate catalyst selected from n-hexylcarborane and n-butylferrocene (5–15) percent by weight are made to serve the dual purpose of suppressing combustion instability and releasing a burning rate promoter or catalyst into the reaction zone of a solid propellant rocket motor. Resonance rods of the disclosed composition undergo minor ablation to thereby expose subsurface quantities of the burning rate promoter (e.g. n-hexylcarborane; n-butylferrocene) which is continuously released for catalysis function for the combustion process.

An alternate to the design of resonance rods containing as a part of the formulation the burning rate promoter is a porous resonance rod wherein the pores of the rod are infiltrated with the burning rate catalyst and optionally, a material for suppressing combustion instabilities.

DESCRIPTION OF THE PREFERRED EMBODIMENT

Resonance rods are fabricated from a typical composition comprised of phenol-formaldehyde resin, a filler selected from carbon black and asbestos, and a burning rate catalyst selected from n-hexylcarborane and n-butylferrocene. The preferred composition provides for minor ablation of the resonance rods during the period that the motor is burning. As ablation takes place, subsurface quantities of the burning rate promoter are exposed and continuously released to catalyze the combustion process.

Examples I–VI, set forth below, illustrate ablative resonance rod formulations to provide varied burning rates in the combustion zone and varied velocity (feet per second) of exhaust gases.

EXAMPLE I

| Ingredient | Percent by Weight |
|---|---|
| Phenol-formaldehyde resin | 40.0 |
| Carbon black | 55.0 |
| n-Butylferrocene | 5.0 |
| TOTAL % by Weight | 100.0 |

EXAMPLE II

| Ingredient | Percent by Weight |
|---|---|
| Phenol-formaldehyde resin | 50.0 |
| Carbon black | 40.0 |
| n-Butylferrocene | 10.0 |
| TOTAL % by Weight | 100.0 |

EXAMPLE III

| Ingredient | Percent by Weight |
|---|---|
| Phenol-formaldehyde resin | 60.0 |
| Carbon black | 25.0 |
| n-Butylferrocene | 15.0 |
| TOTAL % by Weight | 100.0 |

EXAMPLE IV

| Ingredient | Percent by Weight |
|---|---|
| Phenol-formaldehyde resin | 40.0 |
| Carbon black | 55.0 |
| n-Hexylcarborane | 5.0 |
| TOTAL % by Weight | 100.0 |

EXAMPLE V

| Ingredient | Percent by Weight |
|---|---|
| Phenol-formaldehyde resin | 50.0 |
| Carbon black | 40.0 |
| n-Hexylcarborane | 10.0 |
| TOTAL % by Weight | 100.0 |

EXAMPLE VI

| Ingredient | Percent by Weight |
|---|---|
| Phenol-formaldehyde resin | 60.0 |
| Carbon black | 25.0 |
| n-Hexylcarborane | 15.0 |
| TOTAL % by Weight | 100.0 |

The formulation of Example IV was used to form resonance rods for testing in identical rocket motors loaded with the propellant set forth in Table I, below. Thus, in the standard motor using resonance rods without catalyst material, all of the catalyst material was contained in the propellant per se, while the catalyst was reduced in the experimental propellant composition. The reduced amount of catalyst inthe experimental propellant composition was replaced with a non-catalyst material, the plasticizer dibutyl phthalate. Additional catalyst material was contained in the resonance rods with formulation of Example IV.

TABLE I

| Ingredients | Percent by Weight Standard Propellant Composition | Experimental Propellant Composition |
|---|---|---|
| Hydroxyl-terminated Polybutadiene prepolymer | 6.05 | 6.05 |
| Dimeryl diisocyanate | 0.5 | 0.5 |
| Bonding Agent* | 0.35 | 0.35 |
| n-Hexylcarborane | 13.1 | 4.0 |
| Dibutyl phthalate | | 9.1 |
| Ammonium Perchlorate (2.5 $\mu$) | 70.0 | 70.0 |
| Ammonium Perchlorate (30 $\mu$) | 10.0 | 10.0 |

*Bonding agent is formulated of equimolar quantities of tris [1-(2-methyl)-aziridinyl]phosphine oxide, tartaric acid, and adipic acid.

The experimental propellant composition set forth in Table I contained only 4% n-hexylcarborane and 9.1 percent of dibutyl phthalate. Dibutyl phthalate is a plasticizer which exerts no burning rate catalytic effect. The plasticizer was used to achieve consistency between propellants samples tested.

When the identical motors were fired which contained the propellant compositions set forth in Table I, their measured velocity (feet per second) at 77° F was 1370 fps for the standard propellant and 1340 fps for the experimental propellant. Although, the total content of n-hexylcarborane (in rods plus propellant) in the experimental motor was 8.1 percent as opposed to 13.1 percent in the standard motor, it is evident from the delivered velocity which was obtained that the inclusion of the catalyst in the resonance rod resulted in a more effective utilization of the catalyst.

The use of resonance rods with different catalyst content is a means of controlling the burning rate while performing the function of suppressing combustion instability. Thus, all of the catalyst material for burning rate control may be advantageously contained in the rods or as in the experimental propellant, the catalyst may be both in the propellant and rods. The use of resonance rods containing catalyst material is not limited to any size rocket motor. The requirements for a particular motor can be determined by established procedures known in the art.

The catalyst materials included herein are representative of many other types of burning rate catalysts which may be used in accordance with the invention. The use of the catalyst material in accordance with this invention will permit the use of catalyst which may not be compatible if used in the propellant composition per se. Thus, this feature of the invention will enable one to select catalysts which normally could not be used if mixed directly with the propellant composition because of reactivity or incompatibility of the catalyst with the other propellant ingredients.

Asbestos may be substituted for carbon black in any of the above examples.

The propellant burning rate is proportionate to the catalyst concentration which is present in the resonance rods. The shape, number, and location of resonance rods are determined for the particular motor wherein used in accordance with methods known in the art. An alternate means for deriving benefit of the dual purpose resonance rod consists of employing porous resonance rods infiltrated with additives. These infiltrants consist of catalyst material for burning rate promotion (e.g., n-butylferrocene, n-hexylcarborane) and optionally, a material compatible with the catalyst material for suppressing combustion instabilities (e.g., carbon black, asbestos powder, and the like).

The use of a resonance rod containing the burning rate promoter eliminates the problems associated with the following: incompatibility of the promoter with the propellant and insulation, plasticizer migration and oxidative hardening of the propellant surface because of the catalytic activity of the promoter. Since with the use of either type of resonance rod, the catalyst material and material for suppressing combustion instabilities are not required to be incorporated into the propellant; hence, additional benefit of using this invention is derived from the simplication of propellant compounding and processing due to containing fewer ingredients in propellant formulations.

Of particular interest is the benefit of using the described resonance rods in solid propellant motors using fiber-reinforced resin motor cases. A highly significant requirement influencing the utility of such nonmetallic motor cases is that little or no interaction occur between the propellant ingredients and the case because any degradation of the mechanical properties of case would seriously limit its use and could lead to mission failure. Elimination of the catalyst material from the formulation and utilizing the same in resonance rods provides the benefit desired without having the problems associated with the undesirable side effects when the catalyst material is used in the propellant formulation.

I claim:

1. A resonance rod of the type used in a solid propellant rocket motor to control combustion instability, said resonance rod comprised of phenolformaldehyde resin; a filler selected from carbon black and asbestos; and a burning rate catalyst selected from n-butylferrocene and n-hexylcarborane for release into the combustion zone of said rocket motor, said catalyst being releasable continuously into the combustion zone of said rocket motor as the solid propellant burning progresses within said rocket motor.

2. The resonance rod of claim 1 wherein said resin is present in said rod in the amount of from about 40 to about 60 percent by weight of said rod; said filler is present in said rod in the amount of from about 25 to about 55 percent by weight of said rod; and said catalyst is present in said rod in the amount of from about 5 to about 15 percent by weight of said rod.

3. The resonance rod of claim 2 wherein said resin is present in said rod in the amount of about 40 percent by weight of said rod; said filler is carbon black which is present in said rod in the amount of about 55 percent by weight of said rod; and said selected catalyst is n-butylferrocene which is present in said rod in the amount of about 5 percent by weight of said rod.

4. The resonance rod of claim 2 wherein said resin is present in said rod in the amount of about 50 percent by weight of said rod; said filler is carbon black which is present in said rod in the amount of about 40 percent by weight of said rod; and said selected catalyst is n-butylferrocene which is present in said rod in the amount of about 10 percent by weight of said rod.

5. The resonance rod of claim 2 wherein said resin is present in said rod in the amount of about 60 percent by weight of said rod; said filler is carbon black which is present in said rod in the amount of about 25 percent by weight of said rod; and said selected catalyst is n-butylferrocene which is present in said rod in the amount of about 15 percent by weight of said rod.

6. The resonance rod of claim 2 wherein said resin is present in said rod in the amount of about 40 percent by weight of said rod; said filler is carbon black which is present in said rod in the amount of about 55 percent weight of said rod; and said selected catalyst is n-hexylcarborane which is present in said rod in the amount of about 5 percent by weight of said rod.

7. The resonance rod of claim 2 wherein said resin is present in said rod in the amount of about 50 percent by weight of said rod; said filler is carbon black which is present in said rod in the amount of about 40 percent by weight of said rod; and said selected catalyst in n-hexylcarborane which is present in said rod in the amount of about 10 percent by weight of said rod.

8. The resonance rod of claim 2 wherein said resin is present in said rod in the amount of about 60 percent by weight of said rod; said filler is carbon black which is present in said rod in the amount of about 25 percent by weight of said rod; and said selected catalyst is n-hexylcarborane which is present in said rod in the amount of about 15 percent by weight of said rod.

9. The resonance rod of claim 1 wherein said rod is in the form of a porous rod infiltrated with additives; said additives comprising said burning rate catalyst and said filler.

* * * * *